US005816441A

United States Patent [19]

Farside

[11] Patent Number: 5,816,441

[45] Date of Patent: Oct. 6, 1998

[54] TABLET DISPENSER WITH CHILD-RESISTANT LOCKING FEATURE

[75] Inventor: Nicholas Farside, East Petersburg, Pa.

[73] Assignee: Kerr Group, Inc., Lancaster, Pa.

[21] Appl. No.: 591,050

[22] Filed: Jan. 25, 1996

[51] Int. Cl.[6] ..... B65G 59/00

[52] U.S. Cl. ..... 221/152; 221/202; 221/264; 221/276

[58] Field of Search ..... 221/151, 152, 221/202, 264, 276, 281, 243

[56] References Cited

U.S. PATENT DOCUMENTS

| | | | |
|---|---|---|---|
| 1,474,264 | 11/1923 | Kafp | 221/152 |
| 1,600,158 | 9/1926 | Williams | 221/264 |
| 2,683,554 | 7/1954 | Mulhauser, Jr. | 221/152 |
| 3,355,067 | 11/1967 | Espinal | 222/23 |
| 3,833,147 | 9/1974 | Borsum et al. | 221/202 |
| 4,230,236 | 10/1980 | Boulter | 221/190 |
| 4,354,619 | 10/1982 | Wippermann et al. | 221/263 |
| 4,405,060 | 9/1983 | Hsei | 221/135 |
| 4,415,098 | 11/1983 | Haas | 221/202 |
| 4,492,316 | 1/1985 | Emms | 221/202 |
| 4,564,124 | 1/1986 | Burton | 221/263 |
| 4,653,668 | 3/1987 | Gilbilisco et al. | 221/298 |
| 4,767,023 | 8/1988 | Hackmann et al. | 221/152 |
| 4,854,478 | 8/1989 | Gyimothy | 221/190 |
| 5,018,644 | 5/1991 | Hackmann et al. | 221/152 |
| 5,108,006 | 4/1992 | Tieke et al. | 221/152 |
| 5,174,471 | 12/1992 | Kozlowski et al. | 221/154 |
| 5,372,267 | 12/1994 | Hofmann | 215/220 |
| 5,383,559 | 1/1995 | Toren | 206/533 |
| 5,431,283 | 7/1995 | Weinstein et al. | 206/531 |

*Primary Examiner*—H. Grant Skaggs
*Attorney, Agent, or Firm*—Kenyon & Kenyon

[57] ABSTRACT

A dispenser for dispensing tablets one at a time which includes a feature which prevents children from dispensing tablets. The dispenser has a reservoir, a chamber below the reservoir in which the tablets are arranged in a single layer and a dispensing passageway which leads to a dispensing orifice. The passageway is of such a width that a single column of tablets can be accommodated. The passageway is defined by portions of a moving slider member and can be moved from a non-dispensing position to a dispensing position, after an unlocking plunger is depressed. The plunger presses down a biased locking plate to disengage a locking projection on the slider from a locking face in the container. In the dispensing position, the lowermost tablet is dispensed whereas the remaining tablets in the column are retained in the passageway by a fixed protuberance. One side of the passageway is resilient to minimize tablet damage. The slider member is adapted to assist the passage of tablets from the reservoir to the chamber.

15 Claims, 4 Drawing Sheets

TABLET DISPENSER WITH CHILD-RESISTANT LOCKING FEATURE

BACKGROUND OF THE INVENTION

1. Field of the Invention

The present invention relates to containers for the storage and dispensing of tablets, such as medicinal tablets or food tablets requiring a child-proof dispenser, such as, e.g., iron tablets. In order that the dose can be controlled, a dispenser is required which dispenses tablets one at a time. The present invention provides such a dispenser. In addition, the present invention provides a locking feature which makes the dispensing mechanism resistant to operation by children, thereby preventing access by children to the contents of the dispenser.

2. Description of the Prior Art

U.S. Pat. No. 4,492,316 describes a device for dispensing pills or tablets. The device of that patent includes a slider which reciprocates upon finger actuation to segregate and dispense an individual tablet through a dispensing opening. The device of U.S. Pat. No. 4,492,316, however, does not provide any mechanism for preventing a child from actuating the slider and dispensing pills or tablets from the dispenser. The device therefore can be hazardous in households containing children and in which the dispenser contains tablets of harmful substances, for example, medicants.

SUMMARY OF THE INVENTION

The present invention provides a mechanism which makes a dispenser resistant to operation by a child. The dispenser itself includes an outer casing containing a reservoir in which the tablets are randomly orientated and an apparatus for causing the tablets to be transferred from the reservoir. The tablets become arranged in a single layer in a chamber which feeds the tablets into a dispensing passageway which is of such a width that only a single column of abutting tablets can be accommodated. The dispenser also includes a slider mechanism having portions which define the width of the dispensing passageway and is moveable within the outer casing from a first position in which the column of abutting tablets is contained within the outer casing and a second tablet dispensing position in which the column of abutting tablets is aligned with a dispensing opening in the outer casing. The slider mechanism is provided with a mechanism whereby it is urged towards the first position, and a biased plate with a locking projection which locks against a locking face the container to prevent movement of the slider. A plunger passing through the container and actuated at the top of the container may be depressed to unlock the locking projection and allow the slider to reciprocate to dispense tablets. Finally, the dispenser includes a projection which is fixed in position relative to the outer casing in such a position that the projection is not aligned with the column of abutting tablets when the slider mechanism is in its first position but, when the slider mechanism is in its second dispensing position, the projection is aligned with the column of abutting tablets and is interposed between the tablet adjacent the dispensing opening and the remaining tablets in the column to retain the remaining tablets within the passageway so that only the tablet adjacent the dispensing opening can pass through that opening. One of the portions of the slider mechanism which define the width of the dispensing passageway is resilient so that in the event of a tablet being trapped between one of the portions and the projection, the resilient portion will deform to prevent damage to the tablet as the slider mechanism is moved from the first to the second position.

The device for causing the tablets to be transferred and to be arranged in a single layer in the chamber may be part of the slider mechanism which is located adjacent the exit from the reservoir and which, as the slider mechanism is moved between the first position and the second, agitates the tablets near the exit and causes some of the tablets to attain the correct orientation to fall into the chamber. This portion of the slider mechanism may be serrated, and may be part of the plate with the locking projection which is used to lock the slider against dispensing unless a plunger is depressed.

The device for urging the slider mechanism towards the first position may be an integrally-formed resilient portion of the slider mechanism.

The plunger mechanism may be held in a slide bearing in the container and may contain a retention bead to resist removal of the plunger from the container when the lid is closed. The lid for the container may be joined to the container via an integrally-molded flexible hinge.

BRIEF DESCRIPTION OF THE DRAWINGS

The invention will be illustrated by the following description of an embodiment thereof which is given by way of example only and has reference to the accompanying drawings in which.

DETAILED DESCRIPTION OF THE INVENTION

Figure 1:
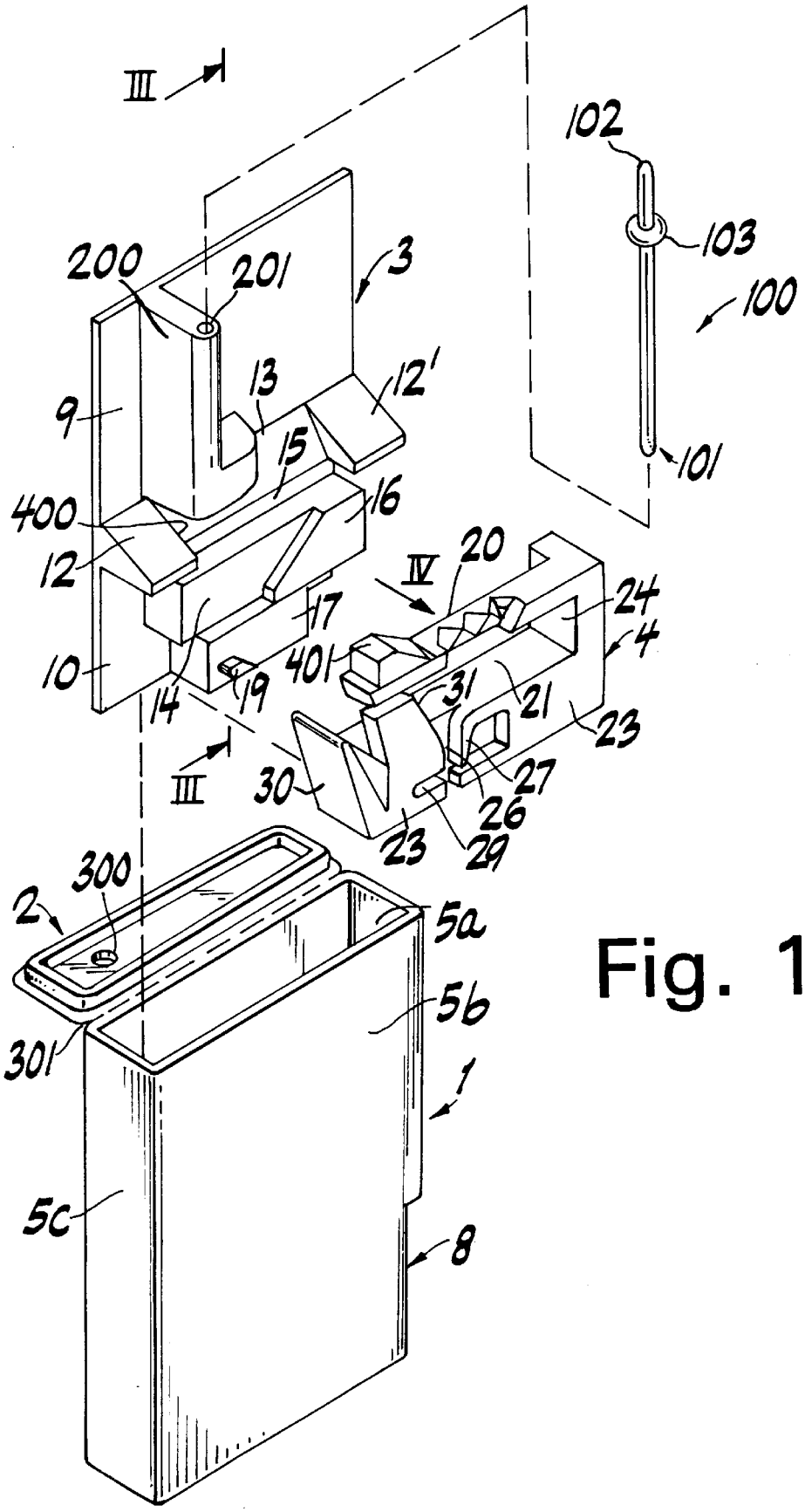
FIG. 1 is an exploded perspective view showing the components of one embodiment of dispenser.

The dispenser as shown includes four parts which are produced from plastic materials, for example by injection molding. These parts are a body portion 1, an inner portion 3, a plunger portion 100 and a slider portion 4.

The lid portion 2 interengages with the upper open end of the body portion 1 and lid portion 2 may be molded in one piece and connected by an integrally molded hinge portion 301. The body portion 1 is a generally cup-shaped member having a peripheral wall 5 and a base 6 having a tablet dispensing opening 7. An opening 8 in the peripheral wall 5 and base 6 is provided to enable the slider portion 4 to be manipulated when the assembled dispenser is in use. The body portion may be made of any suitable plastic material, but polystyrene, polypropylene, ABS or phenolformaldehyde are the preferred materials. The lid portion 2 contains an opening 300 allowing plunger 100 upper end 102 to project out of lid portion 2 when lid portion 2 is closed on body portion 1.

Figure 3:
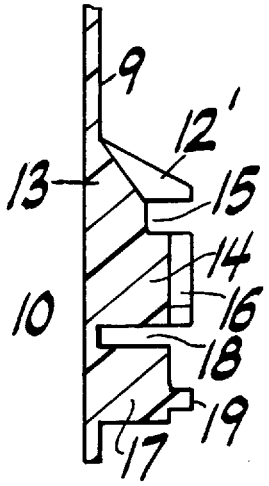
FIG. 3 is a cross-sectional view of one of the components shown in FIG. 1 taken along the line III—III of FIG. 1.
Figure 4:
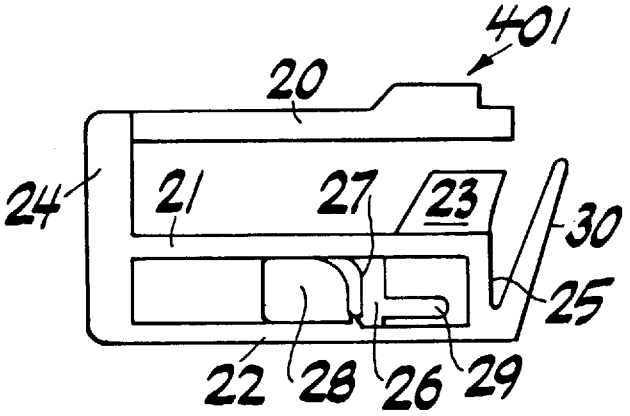
FIG. 4 is a plan view of another of the components shown in FIG. 1 taken in the direction of the arrow IV in FIG. 1.

The inner portion 3 is slidingly fit inside the body portion 1 and includes a flat rear member which includes two rectangular flat members 9, 10. The upper flat member 9 together with the front wall 5*b* and the side walls 5*a*, 5*c* of the peripheral wall 5 and the lid portion 2 define a reservoir 11 in which a supply of tablets to be dispensed can be stored. The lower end of the reservoir 11 is defined partly by a line of sloping projections 12, 12', 13 of which the outermost projections 12, 12'extend across the full width of the interior of the body portion 1. Projection 12 has an inner locking face 400. The projection 12'may be angled so that it also has a slope which directs tablets towards the center of the dispenser. This alternative embodiment is not shown in the Figures. The central projection 13 extends only partially across the width of the interior of the body portion 1 and with the front wall 5*b* of the body portion defines a rectangular slot in the base of the reservoir 11 through which pass the tablets to be dispensed. The lower flat member 10 is also rectangular. The lower flat member 10 has two projections. The first and uppermost projection 14 is substantially rectangular in shape and extends parallel to and below the line of projections 12, 12', 13 from the right hand edge of the lower flat member 10, but it does not extend the full width of the lower flat member 10. As can be seen more clearly from FIG. 3 the projection 14 has a stepped portion 15 which together with the projection 12 provides a guide to receive the slider component 4 as will be described later. The projection 14 also has a generally trapezoidal projection 16 which provides a sloping ramp down which tablets to be dispensed can move. Below the projection 14 is a further projection 17 which is spaced from the projection 14 by a groove 18. The projection 17 has a tablet separating protuberance 19 extending from its otherwise planar upper surface. The inner portion is preferably manufactured in one piece, for example by injection molding, of a suitable plastic material including polystyrene, polypropylene, ABS and phenolformaldehyde resins. The upper flat member 9 includes a slide bearing 200 for receiving plunger portion 100. Slide bearing 200 includes an inner hole 201 into which plunger portion 100 is inserted. A ridge or bead 103 on plunger portion 100 prevents plunger portion 100 from sliding too far within bearing 200 or sliding out of outer portion 1 when lid portion 2 is closed.

Figure 2B:
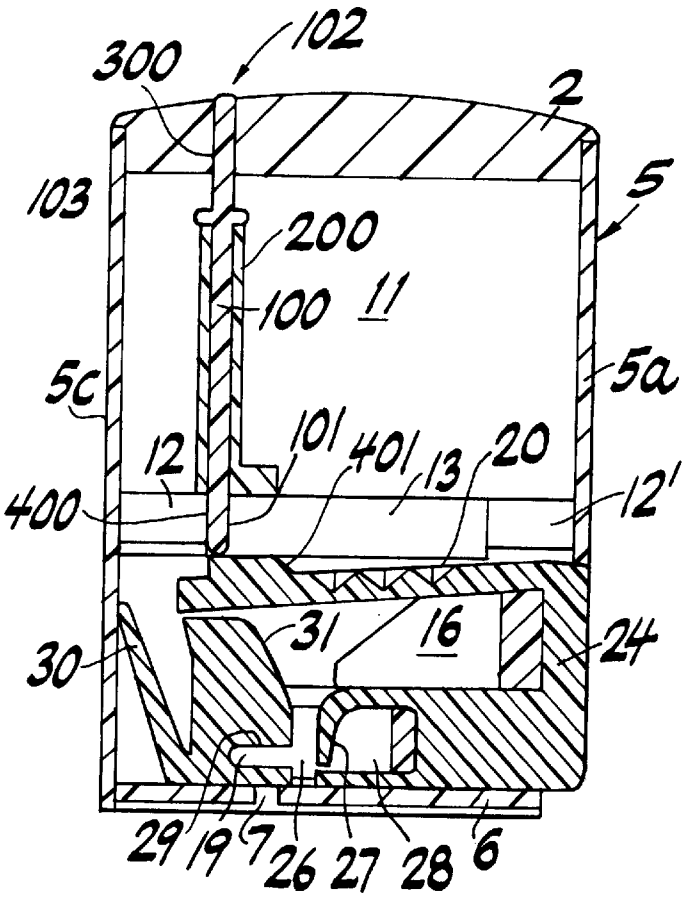
FIG. 2*a* is a cross-sectional view of an assembled dispenser in a locked position and FIG. 2*b* is a cross-sectional view of an assembled dispenser in an unlocked position.
Figure 2A:
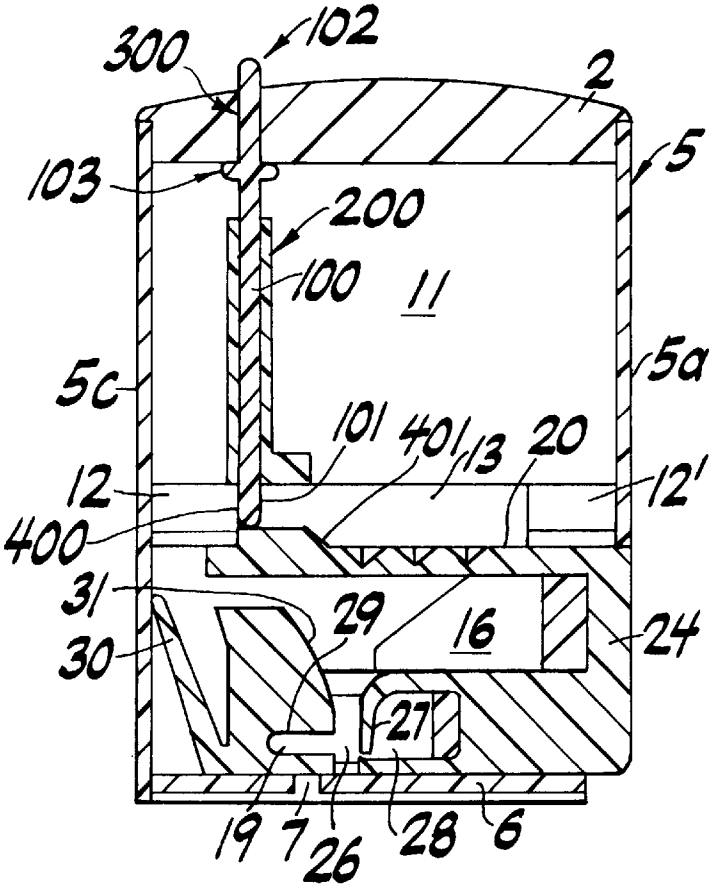

The slider portion 4 is provided with projecting plates 20, 21, 22. Plates 21 and 22 are held in parallel spaced relationship by a front plate 23 and an end plate 24. Uppermost locking plate 20 is cantilevered to end plate 24 and may flex about the point where plate 20 is joined to end plate 24. The plates 21, 22 extend the full width of the slider portion 4 whereas the uppermost locking plate 20 extends only partly across the width of the slider portion. Plate 20 includes a lock projection 401 which abuts locking face 400 in the position of FIGS. 2*a* and 5*a*. In the assembled dispenser, the slider portion 4 is located on the inner portion 3 with the uppermost locking plate 20 located on the stepped portion 15 of the projection 14, the plate 21 is located within the groove 18 and the plate 22 is located below the projection 17. Also in the assembled dispenser, the lower end 101 of plunger 100 engages the upper end of locking projection 401. The slider portion 4 when assembled with the inner portion 3 is able to slide from side to side but the amount of travel towards the right as shown in FIGS. 2*a* and 2*b* is limited because a wall 25 of the slider portion contacts the projection 17 and the amount of travel towards the left as shown in FIGS. 2*a* and 2*b* is limited because the end plate 24 contacts the right hand end of the projection 14. The front plate is formed with a tablet dispensing opening 26 which is bounded on one side by a resilient finger 27 which can flex into the cut-away aperture 28. The opposite side of the opening is provided with a slot 29 which receives the projection 19 when the inner portion 3 is assembled with the slider portion 4. The slider member 4 has a spring member 30 which urges the slider portion to move to the right as shown in FIGS. 2*a* and 2*b*. In an alternative, the member 30 may be replaced by a helical or other type spring. The upper surface of the plate 20 is serrated so as to cause agitation of the tablets to be dispensed. The front wall 23 of the slider portion 4 has a sloping ramp surface 31 located below the serrations in the plate 20. The slider member 4 is preferably manufactured in one piece, for example by injection molding from a plastics material such as acetal, nylon, polypropylene or high density polyethylene.

Figure 5A:
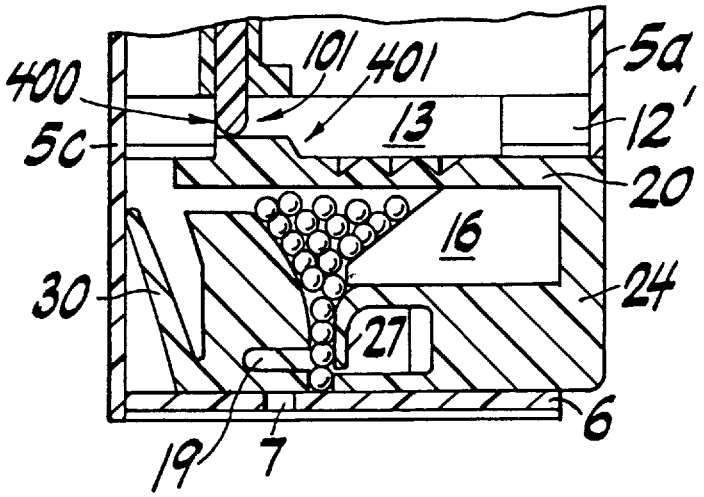
FIGS. 5*a* and 5*b* are diagrammatic representations illustrating the operation of the dispenser.
Figure 5B:
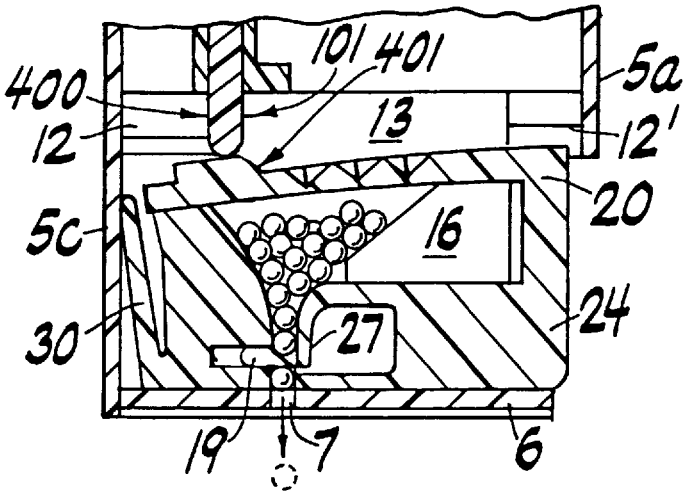

The assembly and operation of the dispenser will now be described. The slider portion 4 is placed on the inner portion 3, and the plunger 100 is inserted into hole 201, and these three components are slid into the outer portion 1. The components will then take up the positions shown in FIG. 2*a* with the end wall 24 of the slider portion 4 extending through the opening 8 in the outer portion 1 and lock projection 401 locking against locking face 400 to prevent leftward movement (as shown in FIG. 2*a*) of the slider portion 4. The reservoir 11 is then filled with tablets and the lid portion 2 placed in a closed position. It is intended that the dispenser will be used in an upright position and that the tablets will be right-cylindrical in shape. The dispenser would however also function if the reservoir 11 was loaded with spherical pills. The tablets will fall to the bottom of the reservoir and some of them will fall through the rectangular slot in the base of the reservoir into a generally triangular chamber defined by the projection 14 at the rear, the front wall 5*b* of the body portion at the front and the generally trapezoidal projection 16 and the sloping ramp surface 31 of the slider portion 4 at the sides. The projection 14 and front wall 5*b* are spaced so that the right-cylindrical tablets can only be located in the triangular chamber with their planar surfaces facing the projection 14 and front wall 5*b* respectively. The tablets are agitated when the slider is moved relative to the inner member 3 by the serrations in the plate 20 so that they take up the correct orientation to fall into the triangular chamber. From the base of the triangular chamber a column of tablets forms in the passageway formed by the planar surfaces of the interior of the front wall 5*b* and the projection 17 and the opening 26. The column of tablets is prevented from falling because the lowermost tablet contacts the base 6 of the outer portion 1. (FIG. 5*a*). As the slider portion 4 is moved to the left as the user presses the end wall 24 of the slider portion 4 with the thumb (after unlocking the slider 4 as described below) the column of tablets is also moved to the left. The protuberance 19 separates the lowermost tablet from the remainder of the tablets in the column and allows the lowermost tablet to fall through the dispensing opening 7 in the base of the dispenser while supporting the remainder of the column within the dispensing passageway (FIG. 5*b*).

In order to dispense tablets from the dispenser, a user preferably places a thumb on the portion of slider 4 projecting through opening 8 and an index or middle finger on the upper portion 102 of plunger 100. Plunger 100 is then depressed by the index or middle finger to the position shown in FIG. 2*b*. Depression of plunger 100 presses down locking plate 20 so that locking projection 401 is disengaged from locking face 400 and moved underneath projection 12 against the bias of the cantilevered locking plate 20. In this position of locking plate 20, see FIG. 2*b*, the slider may move horizontally by thumb pressure to the left. As the slider member is moved to the left the spring member 30 is deformed as shown in FIG. 5*b*. When the user releases the pressure on the end wall 24 the spring member reverts to the orientation shown in FIG. 5*a*, and the locking projection 401 snaps back into engagement with the locking face 400 as the result of the internal bias of locking plate 20. The tablets in the column then fall to fill the column with the lowermost tablet in contact with the base of the outer member 1.

The protuberance 19 is shaped so that as the slider member 4 is moved into the casing and the column of tablets is moved towards the tapered leading edge of the protuberance, the column is separated so that only a single tablet is transported to the dispensing orifice. If, however, there are damaged or misshaped tablets it is possible that the protuberance will not be aligned with the space between the lowermost tablet and the one immediately above it. Under these circumstances a tablet may be urged into contact with the tapered leading edge of the protuberance which could cause the tablet to be damaged. However the resilient finger 27 will flex under these conditions to minimize the damage done to the tablet.

While the invention has been described in the specification and illustrated in the drawings with reference to preferred embodiments, it will be understood by those skilled in the art that various changes may be made and equivalents may be substituted for elements of the invention without departing from the scope of the claims.

I claim:

1. A child-resistant dispenser for dispensing tablets one at a time which comprises:

an outer casing comprising a reservoir and a dispensing opening;

a locking face;

a slider mechanism, said slider mechanism comprising portions which define a dispensing passageway, said slider mechanism being moveable within said outer casing from a first position, in which a column of abutting tablets is contained within said outer casing, and a second tablet dispensing position, in which a tablet is aligned with said dispensing opening, said slider mechanism comprising a locking projection movable from a locking position, wherein said locking projection is engaged with said locking face, to an unlocking position, wherein said locking projection is disengaged from said locking face; and an unlocking element, one end of said unlocking element engaging said slider in said first position, another end of said unlocking element projecting outside said outer casing, movement of said unlocking element from a first position to a second position moving said locking projection from said locking position to said unlocking position.

2. The child-resistant dispenser of claim 1, further comprising:

a biasing element biasing said slider mechanism towards said first position.

3. The child-resistant dispenser of claim 1, further comprising:

a projection which is fixed in position relative to said outer casing such that said projection is not aligned with said column of abutting tablets when said slider mechanism is in its first position, but when said slider mechanism is in its second dispensing position, said projection is aligned with said column of abutting tablets and is interposed between a tablet adjacent said dispensing opening and remaining tablets in said column to retain said remaining tablets within said passageway so that only said tablet adjacent said dispensing opening can pass through said dispensing opening.

4. The child-resistant dispenser of claim 1, further comprising:

said slider mechanism comprises a serrated portion located adjacent an exit from said reservoir and which, as said slider mechanism is moved between its first position and its second position, agitates tablets near said exit.

5. The child-resistant dispenser of claim 1, wherein:

one of said portions of said slider is resilient so as to minimize damage to tablets as said slider mechanism is moved from its first position to its second position.

6. The child-resistant dispenser of claim 1, wherein:

said unlocking mechanism comprises a plunger.

7. The child-resistant dispenser of claim 6, wherein:

said plunger is slidingly mounted in a bearing in said outer casing.

8. The child-resistant dispenser of claim 6, further comprising:

a lid, said lid closing said reservoir, said lid comprising an opening, said another end of said plunger projecting through said opening.

9. The child-resistant dispenser of claim 8, wherein:

said plunger comprises a projection, said projection retaining said plunger in said dispenser when said lid closes said reservoir.

10. The child-resistant dispenser of claim 1, further comprising:

a lid for said reservoir.

11. The child-resistant dispenser of claim 10, wherein:

said lid is mounted to said outer casing by an integrally molded hinge portion.

12. The child-resistant dispenser of claim 1, wherein:

said slider mechanism comprises a cantilevered plate, and wherein said locking projection is mounted on said cantilevered plate.

13. The child-resistant dispenser of claim 12, wherein:

said cantilevered plate is biased toward said locking position.

14. The child-resistant dispenser of claim 1, further comprising:

an inner member located within said outer casing, said inner member comprising sloping projections for directing tablets leaving said reservoir to an opening in said slider mechanism.

15. The child-resistant dispenser of claim 1, wherein:

a portion of said slider mechanism projects from a side of said outer casing, and wherein said another end of said unlocking element projects from an end of said outer casing.

* * * * *